United States Patent [19]

St. Laurent, Jr.

[11] 4,219,042

[45] Aug. 26, 1980

[54] PNEUMATIC RELAY

[75] Inventor: Wilfred H. St. Laurent, Jr., Marblehead, Mass.

[73] Assignee: Bellofram Corporation, Burlington, Mass.

[21] Appl. No.: 945,147

[22] Filed: Sep. 22, 1978

[51] Int. Cl.[3] ..... F15B 5/00

[52] U.S. Cl. ..... 137/85; 251/360

[58] Field of Search ..... 137/85, 86, 84, 116.5; 92/103 R; 251/331, 363, 359, 360

[56] References Cited

U.S. PATENT DOCUMENTS

| | | | |
|---|---|---|---|
| 2,707,481 | 5/1955 | McPherson | 251/331 X |
| 2,825,354 | 3/1958 | DuBois | 137/85 |
| 3,165,262 | 1/1965 | Ollivier | 137/85 X |
| 3,236,158 | 2/1966 | Taplin | 92/103 R |
| 3,413,997 | 12/1968 | Taylor | 137/85 |
| 3,575,189 | 4/1971 | Smith | 137/85 |

*Primary Examiner*—Alan Cohan
*Attorney, Agent, or Firm*—Erwin Salzer

[57] ABSTRACT

A pneumatic relay, and more particularly a pneumatic reversing relay, wherein the output decreases with increasing signal pressure. The relay is of the rolling diaphragm type, each rolling diaphragm including a radially outer clamping flange, a radially inner clamping flange and an intermediate rolling wall. Means are provided for securing clamping flanges of the rolling diaphragms against pull-out, creep and relaxation of clamping forces. The valve has a freely floating valve stem having a high degree of pneumatic stability combined with low stem friction. The freely floating operation is obtained by means of an "O" ring surrounding the valve stem and a baffle plate deforming the "O" ring. The relay includes a bias spring whose bias is controlled by the deformation of a metal bonnet housing the bias spring. Spring retainer caps transmit the deformation of the bias spring in a precise and stable manner. The supply pressure port is connected to a pressure control chamber by a fluid passage including a valve element and a valve seat, the valve stem being surrounded by a helical compression spring positioned to obtain normally closed valve operation. The supply fluid flows past the movable valve element, the fixed supply seal, and along the stem and is then deviated to the pressure control chamber. The stem has a portion of increased diameter which cooperates as valve element with the seat of the exhaust valve. The seat of the supply valve is impact resistant and is affixed to the relay body without use of threads, or like fastener means subject to change of adjustment. The various components of the device are held together by a clamp ring having an opening or window for the admission of signal pressure. Anti-rotation pins are used to prevent relative rotary movement of the parts held together by the clamp ring.

11 Claims, 6 Drawing Figures

PNEUMATIC RELAY

BACKGROUND OF THE INVENTION

This invention relates to fluid-flow devices wherein the quantity of fluid that flows through a nozzle is being regulated by variations of the nozzle gap, i.e. the gap formed between the valve stem and the valve seat. To be more specific, valves according to this invention are more particularly applicable wherever it is desired to provide pneumatic insulation between a fluid stream impinging upon a measuring diaphragm, particularly a rolling diaphragm, and a valve stem cooperating with a valve seat under the action of said diaphragm, or rolling diaphragm. The above referred-to operation of the valve is free floating and is obtained by a perforated flexible or resilient baffle plate through which the valve stem projects, and a contiguous "O"ring closely surrounding the valve stem. This arrangement combines high pneumatic stability with low valve stem friction.

This invention relates more particularly to so-called pneumatic reversing relays though it is not limited to this kind of valves as will be more apparent from the following description of the invention. The embodiment shown in FIG. 1 of the drawings shows a 1:1 reversing relay wherein the output of the relay is a regulated pressure, the magnitude of which depends on the initial pressure and the magnitude of the signal pressure according to the relationship $$\text{Pout} = \text{Pset} - \text{P signal} \quad (1)$$

wherein

Pout = output pressure;

Pset = the set pressure (determined by spring action); and

Psignal = the signal pressure.

Assuming a pneumatic reversing relay is provided with three diaphragms, or three rolling diaphragms, as shown below in greater detail, then the ratios between the effective area of the diaphragms may change, e.g. 1:2; 2:1; 1:3; 3:1; etc. Referring to the effective areas of a three diaphragm pneumatic reversing relay as $A_1$, $A_2$ and $A_3$, then $$K = (A_1 - A_2)/A_3 \quad (2)$$

Combining equations (1) and (2) yields $$\text{Pout} = \text{Pset} - K \cdot \text{Psignal}$$

This equation can be converted to direct rather than reverse acting and would then read $$\text{Pout} = \text{Pset} + K \cdot \text{Psignal}.$$

The above relationships apply both to pneumatic prior art relays and to relays according to the present invention, but the means for complying with them are very different in both instances.

A feature of the present invention consists in that the top portion of the above referred-to valve stem is larger, i.e. has a larger diameter, than the supply seat diameter of a supply valve whose valve element, or pintle, is supported by the same valve stem. A compression spring is arranged between the large diameter portion of the valve-stem of the regulating valve and the valve seat of the supply valve, tending to close both valves. The above valve stem is supported by an "O"ring and the supply valve. This has the advantage of allowing the passageway formed by the relatively narrow lower portion of the valve stem to be used for the admission of supply air and to dispense with a special support for the lower end of the aforementioned valve stem biasing compression spring. This feature and its advantages will become more apparent as this specification proceeds.

The valve element, or pintle, of the supply valve has a novel shape, i.e. its upper end that cooperates with the valve seat is spherical, and its lower end remote from the valve seat is conical, or in the shape of a frustum of a cone. The object of the spherical portion is to establish good contact with the valve seat in the event of angular tilting, and the object of the conical portion is to prevent excessive indentation in the valve seat and to make the part easier to machine and handle during assembly. Prevention of indentation is an important feature since the valve seat consists of a material that can easily be permanently deformed such as, for instance, a plastic, such as an acetal plastic.

The invention further comprises a novel way of attaching the valve seat of the supply valve to the other parts of the valve structure which excels on account of its ruggedness against shock, vibrations and temperature variations, as well as its compactness and low production cost. This aspect of the invention will be described below in greater detail.

As is apparent from the above, pneumatic relays according to this invention include a plurality of diaphragms, or rolling diaphragms. These include a radially inner or central clamping portion or flange, a radially outer annular clamping portion or flange, and an intermediate rolling wall. The diaphragm flanges of prior art rolling diaphragms are subject to pull-out, creep and relaxation of the clamping forces. According to this invention a low compression material such as a felt of random oriented dacron fibers is molded in one or both diaphragm flanges which cooperate with clamping means, or hardware, having a system of concentric circular grooves mating with clamping flange, or flanges, of the rolling diaphragm. When pressure is applied to the clamping flanges of the rolling diaphragm, some of the rubber content thereof is forced into the aforementioned grooves which greatly increases the pull-out resistance of the diaphragm. The low compression material in the flange, or flanges, of the rolling diaphragm reduce the creep and relaxation of the clamping forces.

It will be apparent from the above that the objects of this invention include an improvement of pneumatic relays, in particular pneumatic reversing relays, and an improvement of the constituent parts thereof. The improvements are particularly concerned with the main nozzle structure and its associated parts, the supply nozzle structure and its associated parts and the rolling diaphragms of the structure. Other inventive improvements will become fully apparent as this specification proceeds and will be pointed out in the appended claims.

SUMMARY OF THE INVENTION

A pneumatic relay according to this invention includes a first helical compression spring that tends to move downwardly a movable passageway that forms an exhaust duct from a pressure control chamber to atmosphere. The exhaust duct is acted upon by three rolling diaphragms having fixed radially outer clamping flanges and radially inner clamping flanges that are affixed to said exhaust duct. The rolling diaphragms have different effective areas. Two of the diaphragms are acted upon by a pneumatic signal pressure. If the relay is supposed to operate as reversing relay the total pressure on the rolling diaphragm that opposes the force of the aforementioned helical spring exceeds the total pressure on the rolling diaphragm that acts upon said exhaust duct in the same direction as said spring. The end of the exhaust duct remote from its exhaust end supports a first valve seat cooperating with a valve element that may be formed by one end of the valve stem, or by an additional valve element supported by said valve. The valve stem is acted upon by a spring having one end acting upon the valve stem and another end that is fixedly supported at some point of the relay structure. A pressure control chamber, or pressure regulating chamber, houses said first valve seat and the valve stem, or the first valve element, supported by the valve stem. The control chamber, or pressure regulating chamber, is closed by a rolling diaphragm having a fixed clamping flange and a movable clamping flange that is affixed to said exhaust duct and to said first valve seat forming part of it. Therefore, the pressure in said control chamber determines the position of said first valve seat relative to the valve stem. If the pressure in said control chamber is relatively high, the first valve seat is lifted from the first valve element, or from the valve stem forming the first valve element, and fluid is allowed to escape from the pressure control or regulating chamber until equilibrium conditions are re-established. A pneumatic relay according to this invention further includes means admitting fluid under pressure from a supply of fluid under pressure to said control chamber. Said means include a second fixed valve seat and an extension of said valve stem supporting a second valve element cooperating with said second valve seat. If the supply pressure rises, said second valve closes. This reduces the volume of fluid under pressure admitted into the regulating chamber, causing the radially inner clamping flange of its rolling diaphragm to lower said first valve seat and said duct toward said stem and thus to decrease venting of the pressure control chamber until equilibrium conditions are re-established. The reverse occurs when the supply pressure drops.

The means for admitting supply fluid under pressure from a supply of fluid under pressure to said control chamber further include a supply passageway extending substantially parallel to the aforementioned valve stem.

The output passageway of the valve communicates with the pressure control chamber thereof. The aforementioned stem projects transversely through said output passageway. Flexible sealing means are interposed between the aforementioned pressure control chamber and the aforementioned output passageway adapted to allow movement of the aforementioned stem in a direction longitudinally thereof.

DESCRIPTION OF PREFERRED EMBODIMENT

Figure 1:
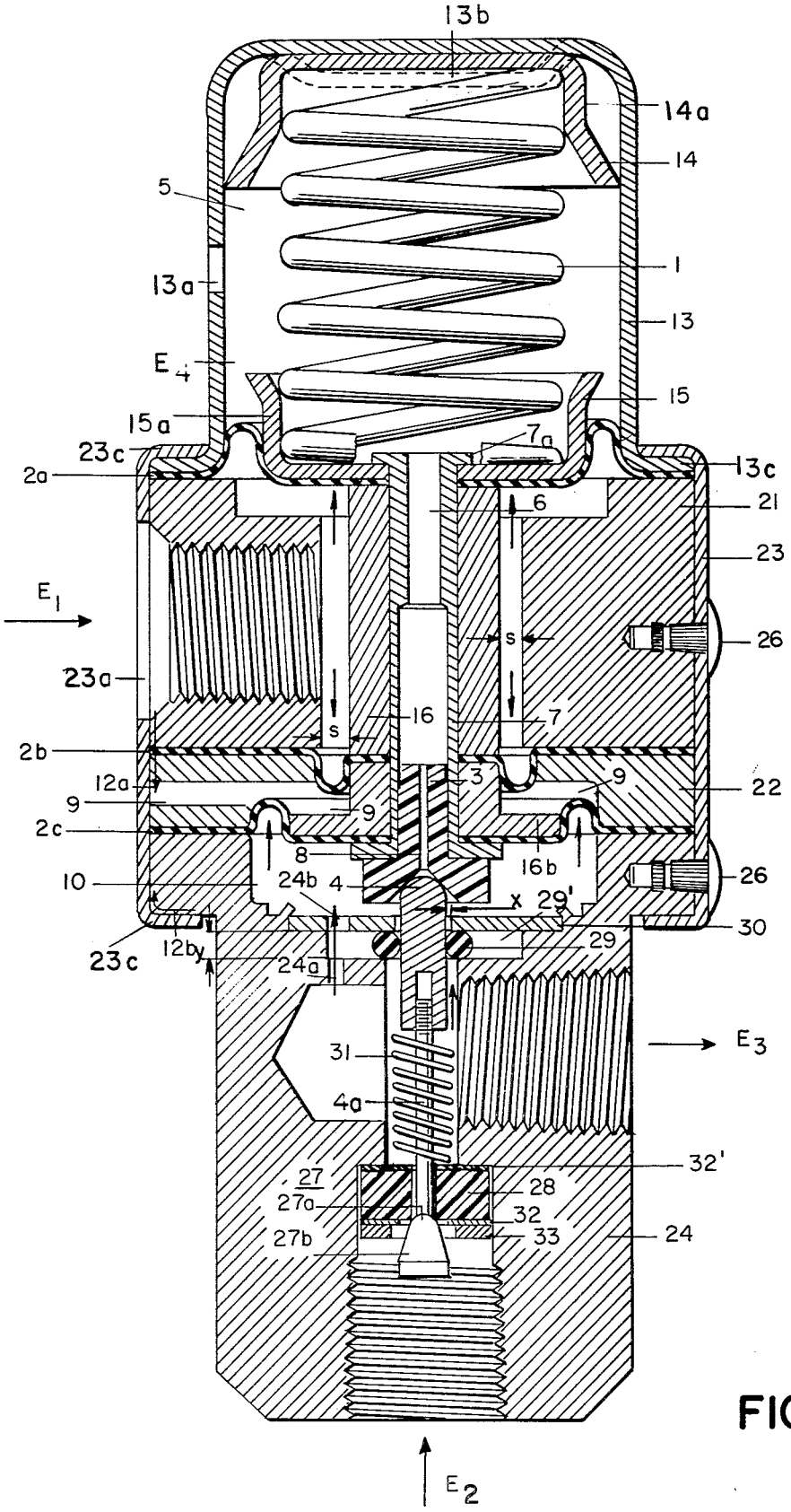
FIG. 1 is substantially a vertical section of a pneumatic reversing relay embodying the present invention.

Referring now to the drawings, and more particularly to FIG. 1 thereof, $E_1$ has been applied to indicate a port for the admission of signal pressure, $E_2$ a port for the admission of supply pressure, $E_3$ a port for the outlet of ouput pressure and $E_4$ a space wherein atmospheric pressure prevails. The unregulated supply pressure is typically air pressure in the range of 50 psig to 120 psig, the regulated output pressure is typically air pressure of 30 psig to 0 psig and the signal pressure is typically 0 psig to 30 psig.

With zero signal pressure output pressure is determined by the preset spring force of compression spring 1, similar to a preset pressure regulator. When signal pressure $E_1$ is increased, the output pressure $E_3$ drops. This is so because the signal diaphragms 2*a*, 2*b* have a different effective area, i.e. because the effective area of rolling diaphragm 2*a* exceeds that of rolling diaphragm 2*b*, resulting in an upward movement of valve seat 3, i.e. an increased separation of valve seat 3 from valve stem 4. The chamber 5 defined by bonnet 13 and housing spring 1, the passageway 6 defined by tubular member 7, and the passageway 8 in valve seat 3 are always under atmospheric pressure. This applies also to chamber 9 into which atmospheric pressure may leak by gaps indicated by arrows 12*a* and 12*b*. Rolling diaphragm 2*c* separates chamber 9 from the mixing chamber 10 where regulated supply air is mixed with atmospheric air admitted through passageway 8. As indicated above, atmospheric pressure prevails in chamber 9 on account of the fact that clamping ring 23 admits atmospheric pressure to it via passageways marked 12*a* and 12*b*.

Figure 2:
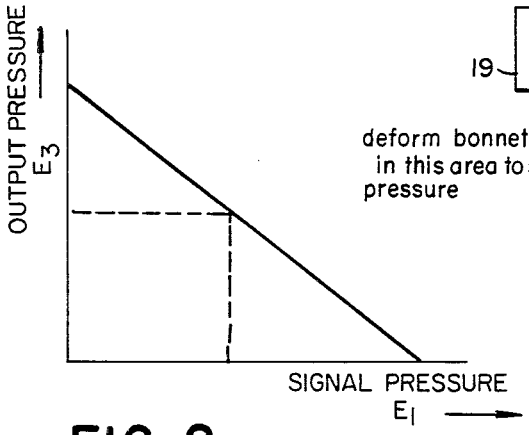
FIG. 2 is an operating characteristic of the relay shown in FIG. 1.

As stated above, an increase in signal pressure $E_1$ results in a drop of output pressure $E_3$, all other parameters remaining unchanged. The resultant force on rolling diaphragms 2*a*, 2*b* and 2*c* is in the direction that tends to compress spring 1, producing a decrease in output pressure $E_3$. This has been diagrammatically shown in FIG. 2 wherein output pressure $E_3$ has plotted against signal pressure $E_1$. In drawing FIG. 2 it has been assumed that there is a predetermined output pressure $E_3$ if the signal pressure $E_1$ is 30 psig, and that the output pressure $E_3$ drops linearily to zero when the signal pressure $E_1$ increases to a predetermined value.

Normally the setting spring 1 of any valve, or the like, is regulated by a screw which regulates its setting, e.g. the initial compression of the setting spring. The adjustment of the setting or spring bias by means of screw threads, or other potentially unstable means, has been found to be objectionable, and is avoided by the design shown in FIG. 1. As shown in that figure the setting spring 1 is surrounded by a bonnet 13 which has an aperture 13*a* for the entry of air under atmospheric pressure. Spring 1 rests with its upper end against a cylindrical spring retainer cup 14 whose lower end is flaring out, i.e. increases in diameter. The lower end of spring 1 rests in a similar spring retainer cup 15 whose upper end is flaring out or has the shape of a frustum of a cone. The upper end of tubular member 7 is bent 90 deg. at 7*a* and thus affixed for joint movement to lower spring retaining cup 15. To change the set pressure, the top of bonnet 13 is deformed as indicated in dotted lines 13*b* in FIG. 1, thus increasing the bias of spring 1 upon tubing 7 and the parts that are affixed to tubing 7 and jointly moving with tubing 7, i.e. the radially inner clamping flanges of rolling diaphragms 2*a* and 2*b*, the radially inner clamping flange of rolling diaphragm 2*c* and the valve seat 3 of plunger 4.

Figure 3:
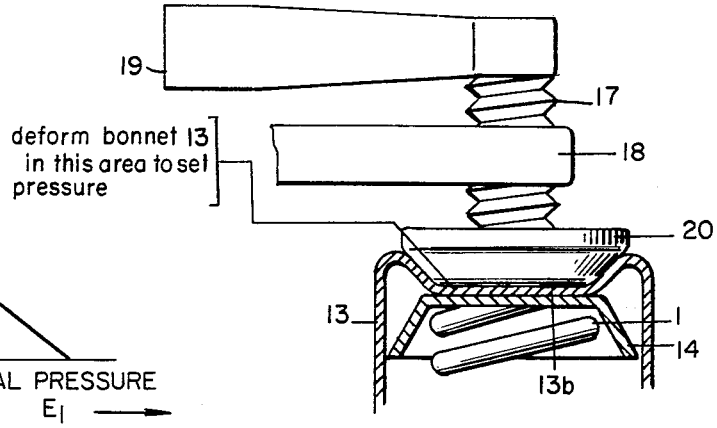
FIG. 3 is a diagrammatic elevation of a tool for deforming the spring bonnet of the relay shown in FIG. 1.

The deformation of the top of bonnet 13 indicated at 13*b* is an operation requiring utmost precision and must, therefore, be carried out with an appropriate tool. A tool which may be used to this end has been diagrammatically shown in FIG. 3. It comprises a screw-threaded rod 17 supported by a fixed arm 18. The upper end of screw-threaded rod 17 may be operated manually by an operating lever 19, and the lower end of screw-threaded rod 17 supports a plunger 20 supposed to engage to top 13*b* of bonnet 13 and to press the same axially inwardly to any desired extent.

The sleeve 16 and a coaxial extension of it are inserted into blocks 21 and 22. There is a clearance s between sleeve 16 and blocks 21 and 22 so that the signal pressure $E_1$ entering block 21 may act on rolling diaphragms 2*a* and 2*b*, and tend to produce a set balance between the pressure of spring 1 and the pressures acting on rolling diaphragms 2*a* and 2*b*. The two blocks 21 and 22 are prevented from moving in radial direction relative to each other by a clamp ring 23. The upper end of clamp ring 23 is bent at 90 deg. around a flange 13*b* of larger diameter integral with bonnet 13. The lower end of clamp ring 23 is bent around a portion of increased diameter of a block 24 which defines inter alia the port for the admission of supply pressure $E_2$ and the port for the exhaust of output pressure $E_3$. Anti rotation pins 26 project radially inwardly or transversely through clamp ring 23 into blocks 21 and 24 and prevent any rotary motion of blocks 21 and 24 relative to one another.

Block 24 houses the supply valve 27, 28 and defines the pressure control or mixing chamber 10. The supply valve 27, 28 comprises the movable valve element, or pintle, 27 cooperating with the supply air valve seat 28, which is preferably made of an acetal plastic. Supply air admitted through valve 27, 28 flows along a passageway indicated by an arrow that has a larger cross-section than the upper portion of valve stem 4, and thus establishes a clearance between the lower portion of valve stem 4 and the wall of block 24 surrounding it. In other words, the lower portion of stem 4 has a smaller cross-section than its upper portion, thus establishing the aforementioned clearance. A portion of the supply fluid is deviated from its straight path by stem 4 and "O"ring 29 and flows through bore 24*a* in block 24 and bore 24*b* in baffle plate 30 into chamber 10. Chamber 29′ accommodates the "0" ring 29 of a resilient material, e.g. an elastomere, which surrounds the upper large diameter portion of valve stem 4. Reference numeral 4 has been applied to indicate the valve stem in general, while numeral 11 indicated the cylindrical portion of valve stem 4. The upper spherical portion of stem 4 cooperates with valve seat 3 to vent more or less fluid or air under pressure from mixing chamber 10. Chamber 29′ is covered by a baffle plate 30 which has a first perforation in registry with valve stem 4 and is occupied by the latter. The pressure in mixing chamber 10 acts upon diaphragm 2*c*. It will be apparent that when signal pressure $E_1$ increases, all other parameters remaining unchanged, the resultant force on spring-piston assembly 1, 7 and 3 increases in a direction that compresses set spring 1, thus increasing the gap between valve seat 3 and valve stem 4 and increasing the venting of chamber 10 and decreasing the output pressure $E_3$.

Figure 4:
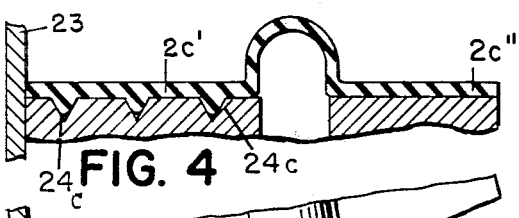
FIG. 4 is a cross-section of a rolling diaphragm according to this invention, and parts associated with it.
Figure 5:
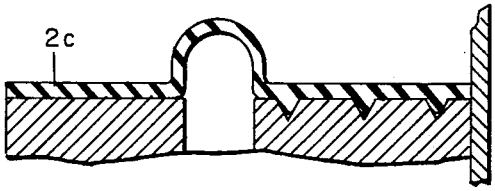
FIG. 5 is a section of a rolling diaphragm according to FIG. 4 and of parts associated with it.
Figure 5:
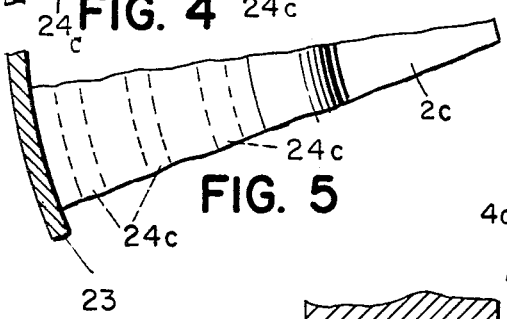

FIGS. 4 and 5 show rolling diaphragm 2*c*, but other rolling diaphragms such as diaphragms 2*a* and 2*b* may be constructed in the same or similar fashion, and this applies also to rolling diaphragms of other pneumatic or hydraulic devices. One or both flanges 2*c*′, 2*c*″ of the diaphragm include, in addition to an elastomere, a low compression material, such as a felt like substance of random oriented fibers, and cooperates with a system of concentric circular grooves 24*c* coaxial with spring 1. Grooves 24*c* cooperate with clamping flange 2*c*′ of which some of its elastomeric material is displaced when pressure is applied to the clamping flanges. Rolling diaphragm 2*c* includes a filamentary supporting system that is impregnated with an elastomere. Such rolling diaphragms are described in U.S. Pat. No. 3,236,158 to John F. Taplin; 02/22/66 for ROLLING DIAPHRAGMS.

Figure 6:
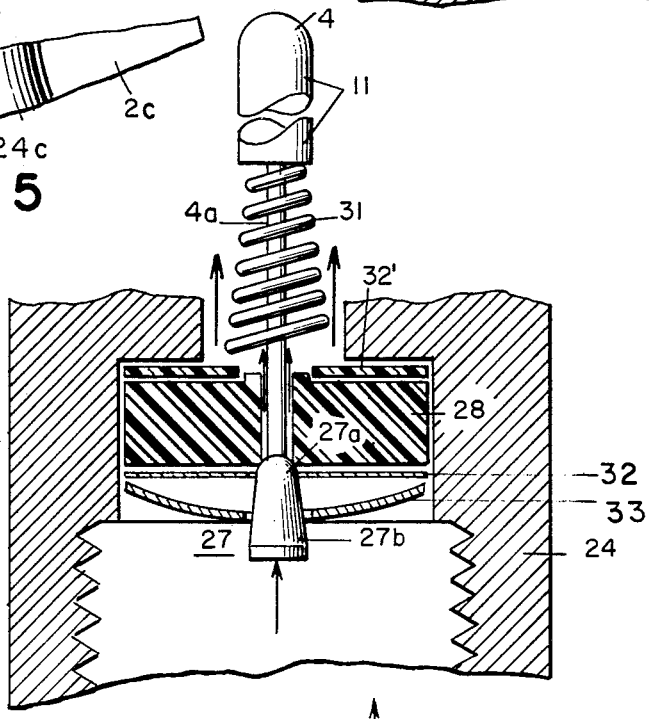
FIG. 6 is an exploded view of some of the essential parts of the relay of FIG. 1.

FIG. 6 shows the valve element, or pintle, of supply valve 27, 28 as comprising an upper or hemispherical portion 27*a* and a lower portion 27*b* in the shape of a frustum of a cone. The lower portion 4*a* of stem 4 projects through a bore in the valve seat 28. Stem portion 4*a* has a smaller cross-section than the upper portion of valve stem 4, so as to provide an intake passage for supply air or other media. Interposed between the portion of valve stem 4 that has a relatively wide diameter and valve seat 28 is a valve stem compression spring 31. Positioned on the lower side of valve seat 28 is a Belleville spring 32 and a flattened spherical washer 33. Plastic seat 28 is topped by a rubber washer 32′.

As will be apparent from the above, valve stem 4 is freely floating by the presence of "O"ring 29 and baffle plate 30. The former provides a controlled friction damping on valve stem 4. The radial clearance X between baffle plate 30 is approximately equal to 50% of the diameter Y of "O"ring 29, the axial compression of "O"ring 29 is approximately 7% of the thickness of "O"ring 29 and the diametrical interference between the "O"ring is approximately 10% of the thickness thereof. These values are indicative rather than critical.

It will be noted from the above that the highly impact-resistance acetal plastic valve seat 28 is secured to the body 24 without use of threaded screws or plugs. This results in an assembly that is more rugged against shock and vibrations as well as variations in temperature compared with prior art designs, and also more compact and less expensive to manufacture. The aforementioned Belleville spring 32 and flattened spherical washer 33 are the means for affixing the plastic valve seat of acetal plastic to block 24. Washer 33 is flattened during assembly producing an interference fit on the outside diameter thereof. The spring action of the washer 33 produces an axial clamping force between the washer and the valve seat 28.

The above referred-to clamping ring 23 is a novel means for clamping together the components of the device, in particular blocks 21, 22 and 24. An aperture 23*a* in clamping ring 23 provides access to the port for admission of signal pressure $E_1$. The antirotation pins 26 prevent twisting of one component relative to another when pressure fittings are installed in the reversing relay.

The compression spring 31 positioned between the upper portion of valve stem 4 and plastic seat 28 effects normally closed valve operation, i.e. closing of valves 3,4 and 27,28. It is desirable to design valve 3,4 in such a way that when force balance conditions prevail, a small constant stream of air flows from chamber 10 through passageway 8 to atmosphere. This can be achieved by providing fine channels in valve stem 4 through which fluid under pressure can escape from chamber 10 into passageways 8 and 6 under force balance conditions.

Considering the structure described above in steady state conditions, it is then subjected to upward directed forces and to downward directed forces which are equal and in balance.

The downward directed forces are the force of spring 1 acting on spring retainer 15 which will be referred-to hereinafter as $F_1$.

Another downward directed force is that of the signal pressure $E_1$ on the rolling diaphragm 2b whose radially inner clamping flange is clamped between parts 16 and 16b and whose radially outer clamping flange is clamped between parts 21 and 22. That force will be referred-to hereinafter as $F_2=E_1 \cdot A_{2b}$.

The upward directed forces are the force of signal pressure $E_1$ on rolling diaphragm 2a whose radially outer clamping flange is clamped between flange 13c of bonnet 13 and block 21, and whose radially inner clamping flange is clamped between spring retainer cap 15 and tubular member 16. This force will be referred-to as $F_3=E_1 \cdot A_{2a}$.

Another upward directed force is the force of the output pressure $E_3$ on rolling diaphragm 2c . The radially outer clamping flange of that diaphragm is clamped between part 22 and block 24, and the radially inner part of that diaphragm is clamped between tubular part 16b and a flange formed by tubular part 7.

The upward force acting on diaphragm 2c will hereinafter be referred-to as $F_4=E_3 \cdot A_{2c}$.

In the above equation A is an abbreviation for the effective area of the diaphragm and the subscript such as, e.g. 2c indicates the particular diaphragm.

Another force acting in upward direction is that of compression spring 31 arranged between valve seat 28 and the portion of valve stem 4 having a relatively wide diameter. That force will hereinafter be referred-to as $F_5$.

Still another force acting normally in upward direction is that exerted upon pintle or valve element 27. That force will hereinafter be referred-to as $F_6=(E_2-E_3) \cdot A_{27}$.

The force balance equation for this system is

Forces up=Forces down; or $$F_1+F_2=F_3+F_4+F_5+F_6; \text{ or}$$

$$F_1+E_1 \cdot A_{2b}=E_1 \cdot A_{2a}+E_3 \cdot A_{2c}+F_5+(E_2-E_3) \cdot A_{27}.$$

As mentioned above, when the signal pressure $E_1$ increases, the difference in the area of diaphragm 2a and 2b causes an upward pressure on spring 1, joint raising of valve seat 3 and valve stem 4, increase of the volume of chamber 10 and consequent decrease of output pressure $E_3$. This is true as long as the supply pressure $E_2$ remains constant.

If the supply pressure $E_2$ increases, all other parameters remaining unchanged, valve 27,28 is further closed, spring 31 is further compressed and exerts a larger upward pressure on stem 4. Less supply air is admitted by openings 24a and 24b into chamber 10 and the pressure on diaphragm 2c is reduced, as a result of which venting thereof through passageway 8 is reduced. This reduces the output pressure $E_3$. The reverse takes place when the supply pressure $E_2$ decreases, all other parameters remaining unchanged.

In the foregoing the structure and operation of relays according to this invention have been fully described. However, additional description of some details which have been generally described above may be useful.

The arrangement of compression spring 1 is not limited to the present structure, but may be used in connection with other pneumatic or hydraulic devices. Bonnet 13 must have a considerably larger diameter than spring 1. Spring retainer cups 14 and 15 include cylindrical portions 14a,15a the diameter of which is substantially equal to the diameter of spring 1 and flaring portions, or portions in the shape of the frustum of a cone. The clearance between at least one of the spring retainer cups 14 and the bonnet 13 should be minimal.

The rolling diaphragm structure shown in FIGS. 4 and 5 is not limited to the relay structure shown, but may be used in connection with many other pneumatic or hydraulic devices.

The assembly of the structure shown in FIG. 1 is greatly facilitated by clamping ring 23 and pins 26. The flanges 23a of clamping ring 23 are bent 90 deg. relative to the cylindrical portion thereof. The diameters of clamping flange 13c of bonnet 13, of the clamping flange of block 21, of the clamping flange of block 24, and of the clamping flanges 23a of clamping ring 23 are substantially equal.

I claim as my invention:

1. A pneumatic relay comprising (a) a first helical compression spring;

(b) a movable exhaust-passageway-defining duct acted upon by said first compression spring, said duct having a permanently open venting end and an end opposite said venting end supporting a first movable valve seat;

(c) a valve stem and first valve element both jointly movable relative to said first valve seat to change the cross-sectional area between said valve seat and said first valve element;

(d) a second helical compression spring of which one end is fixedly supported and the other end acts upon said valve stem in a direction opposite to said first compression spring;

(e) a first rolling diaphragm having a predetermined effective area and having a fixed clamping flange and a movable clamping flange affixed to said duct, said first rolling diaphragm being under the action of a pneumatic pressure signal opposite in direction to the force exerted by said first spring upon said duct;

(f) a second rolling diaphragm having an effective area different from said predetermined effective area of said first rolling diaphragm, and said second rolling diaphgragm having a fixed clamping flange and a movable clamping flange affixed to said duct, and said second rolling diaphragm being under the action of said pneumatic pressure signal in the same direction as the force exerted by said first compression spring upon said duct;

(g) a pressure control chamber housing said first valve seat and said first valve element;

(h) a third rolling diaphragm closing one side of said pressure control chamber, said third rolling diaphragm having one fixed clamping flange and one movable flange affixed to said duct and jointly movable with said valve seat;

(i) means for admitting supply fluid under pressure from a supply of fluid under pressure to said pressure control chamber, said means including a second fixed valve seat, an extension of said valve stem supporting a second valve element cooperating with said second fixed valve seat and a supply passageway extending substantially parallel to said extension of said valve stem; and (j) an output passageway having one end communicating with said control chamber, said stem projecting transversely through said output passageway, and flexible sealing means interposed between said pressure control chamber and said output passageway adapted to allow movement of said stem in a direction longitudinally thereof.

2. A pneumatic relay as specified in claim 1 wherein said sealing means include an "O"ring under pressure surrounding said valve stem and housed in a chamber covered by a baffle plate having two perforations, one perforation for the passage of said stem through said baffle plate and the other perforation for admitting supply fluid to said pressure control chamber.

3. A pneumatic relay as specified in claim 2 wherein said "O"ring is enclosed in a chamber wherein said perforation in said baffle plate for the passage of said stem is arranged in the center of said baffle plate, and wherein said perforation for admitting supply fluid to said pressure control chamber is arranged off-center of said baffle plate.

4. A pneumatic relay as specified in claim 1 wherein the portion of said valve stem adjacent said first valve seat is larger than the portion of said valve stem remote from said first valve seat, wherein said second helical compression spring surrounds said portion of said valve stem remote from said first valve seat, and wherein said portion of said valve stem remote from said first valve seat forms a passage for supply fluid derived from said second valve seat in a direction longitudinally of said second valve seat and longitudinally of said valve stem.

5. A pneumatic relay as specified in claim 1 wherein said second fixed valve seat is of a plastic material and positioned in a valve-seat-receiving recess by a flattened spherically shaped washer and a Belleville spring insuring an axial clamping force between said Belleville spring, said washer and said valve seat.

6. A pneumatic relay as specified in claim 5 wherein said fixed valve seat is of an impact resistant acetal plastic.

7. A pneumatic relay as specified in claim 1 including means for securing clamping flanges of said first, second or third rolling diaphragm against pullout, creep and relaxation of clamping forces, said means including a low compression material forming part of said clamping flanges and a system concentric circular grooves coaxial with said first compression spring cooperating with said clamping flanges into which some of said rubberized material of said clamping flanges is displaced when pressure is applied to said clamping flanges.

8. A pneumatic relay as specified in claim 7 wherein said low compression material includes random oriented fibers.

9. A pneumatic relay as specified in claim 1 wherein said second valve element includes a spherical surface engaging said second fixed valve seat and a surface in the shape of a frustum of a cone arranged at the side of said second valve element remote from said second fixed valve seat.

10. A pneumatic relay as specified in claim 1 wherein said means for admitting supply fluid to said pressure control chamber further include a flow path along the portion of said valve stem adjacent said second fixed valve seat, a passageway arranged laterally of said valve stem and leading to said pressure control chamber, and sealing means including an "O"ring surrounding said valve stem for deflecting said supply fluid from the longitudinal direction of said valve stem laterally into said pressure control chamber.

11. A pneumatic relay as specified in claim 1 including (a) a substantially cylindrical bonnet housing said first helical compression spring and having a flange portion of increased diameter at one of the ends thereof;

(b) a substantially cylindrical first block housing said exhaust-passageway-defining duct, and said first and said second rolling diaphragm;

(c) a substantially cylindrical second block defining said pressure control chamber, housing said valve stem, said second helical compression spring and said means for admitting supply fluid to said pressure control chamber;

(d) said first block and said second block each having a portion of increased diameter substantially equal in diameter to said bonnet and said flange portion of said bonnet engaging said fixed clamping flange of said first rolling diaphragm;

(e) a substantially cylindrical clamping ring having projections of 90 degrees at the axially outer ends thereof, one of said projections engaging said flange portion of said bonnet and the other of said projections engaging said portion of increased diameter of said second block and exerting an axial clamping pressure against said flange portion of said bonnet and upon said portion of increased diameter of said second block;

(f) a first anti-rotation pin projecting transversely through said clamping ring radially inwardly into said first block;

(g) a second anti-rotation pin projecting transversely through said clamping ring radially inwardly into said second block; and (h) said first and said second anti-rotation pin preventing relative rotational movement of said first block and said second block.

* * * * *